United States Patent [19]

Hiraga

[11] Patent Number: 4,551,078

[45] Date of Patent: Nov. 5, 1985

[54] SCROLL-TYPE FLUID DISPLACEMENT APPARATUS WITH ANGULAR OFFSET VARYING MEANS

[75] Inventor: Masaharu Hiraga, Honjyo, Japan

[73] Assignee: Sanden Corporation, Gunma, Japan

[21] Appl. No.: 310,312

[22] Filed: Oct. 9, 1981

[30] Foreign Application Priority Data

Oct. 9, 1980 [JP] Japan ..... 55-141666

[51] Int. Cl.[4] ..... F01C 1/04; F01C 21/16

[52] U.S. Cl. ..... 418/16; 418/55; 418/57

[58] Field of Search ..... 418/16, 55, 57, 107–109

[56] References Cited

U.S. PATENT DOCUMENTS 4,082,484 4/1978 McCullough ..... 418/57

4,178,143 12/1979 Thelen et al. ..... 418/57

*Primary Examiner*—John J. Vrablik

*Attorney, Agent, or Firm*—Banner, Birch, McKie & Beckett

[57] ABSTRACT

A scroll type fluid displacement apparatus, in particular, a compressor unit is disclosed. The unit includes a housing, a pair of scroll members which are comprised of an end plate and a spiral wrap extending from one surface of the end plate. Both wraps interfit to make a plurality of line contacts between their spiral curved surfaces. A driving mechanism and a rotation preventing mechanism are connected to one of the scroll members to effect relative orbital motion while rotation of the scroll member is prevented. A turning mechanism is associated with one of the scroll members to selectively turn the scroll member and vary the angular offset between the wraps, whereby the compressive effect of the scroll members can be controlled independently of the operation of the driving mechanism.

6 Claims, 16 Drawing Figures

SCROLL-TYPE FLUID DISPLACEMENT APPARATUS WITH ANGULAR OFFSET VARYING MEANS

BACKGROUND OF THE INVENTION

This invention relates to fluid displacement apparatus, and in particular, to fluid compressor units of the scroll type.

Scroll type fluid displacement apparatus are well known in the prior art. For example, U.S. Pat. No. 801,812 discloses a device including two scroll members each having an end plate and a spiroidal or involute spiral element. The scroll members are maintained angularly and radially offset so that both spiral elements interfit and meet at a plurality of line contacts between the spiral curved surfaces, to thereby seal off and define at least one pair of fluid pockets. The relative orbital motion of these scroll members shifts the line contacts along the spiral curved surfaces and, therefore, changes the volume in the fluid pockets. The volume of the fluid pockets increases or decreases depending on the direction of orbital motion. Therefore, the scroll type fluid displacement apparatus is applicable to compress, expand or pump fluids.

The scroll type fluid displacement apparatus is suitable for use as a refrigerant compressor for an automobile air conditioner. Generally, it is desirable that the compressor should be compact and light in weight so that it can fit comfortably within the engine compartment and not add appreciably to vehicle weight. However, the compressor for an automobile air conditioner is generally connected to a magnetic clutch at the housing and outer portion of the drive shaft to transmit the rotary output of the engine to the drive shaft of the compressor. The weight of the magnetic clutch is therefore added to the weight of the compressor unit, to thereby increase the total weight of the compressor unit. A pulley which is included in the magnetic clutch is rotatably supported on a sleeve portion of the compressor by a bearing, and a magnetic coil is disposed within an annular cavity of the pulley. The radial diameter of the compressor is therefore restricted by the diameter of the bearing.

A scroll type displacement apparatus is capable of operating at high speed, because the relative rubbing speed between the scroll members can be made quite low, since the orbiting scroll member is driven at a very small orbital radius. However, the diameter of the pulley is restricted by the diameter of the bearing or magnetic coil; therefore, the drive ratio is limited.

When a compliant "vertical crank" mechanism (which changes the orbital radius of orbital motion as required) is used as a driving mechanism for the orbiting scroll member, the orbiting scroll member is rotatably supported on the driving mechanism, allowing the orbiting scroll member to swing around the driving mechanism when the compressor is not in operation. In this case, the swinging scroll member can interfere with the fixed scroll member, which may cause vibration of the engine during driving a car, and either or both of the scroll members may be damaged.

SUMMARY OF THE INVENTION

It is a primary object of this invention to provide an improved fluid displacement apparatus, in particular, a scroll type fluid compressor, wherein compressive operation of the compressor can be controlled without the use of a magnetic clutch.

It is another object of this invention to provide an improvement in a fluid displacement apparatus, in particular, a scroll type fluid compressor in which movement of the orbiting scroll member is arrested when the compressor is not in operation, so that vibration and damage to the scroll member are prevented.

It is still another object of this invention to provide a fluid displacement apparatus, in particular, a scroll type fluid compressor which is compact in size, light in weight and low cost.

A scroll type fluid displacement apparatus according to this invention includes a housing having a fluid inlet and a fluid outlet. A fixed scroll member is fixedly disposed relative to the housing and has an end surface from which a first wrap means extends. An orbiting scroll member has an end plate means from which a second wrap means extends. The first and second wrap means interfit at an angular offset to make a plurality of line contacts to define at least one pair of sealed off fluid pockets. Drive means is operatively connected to the orbiting scroll member to effect orbital motion of the orbiting scroll member. Rotation preventing means is disposed within the housing for preventing rotation of the orbiting scroll member while it orbits. Therefore, the fluid pockets change in volume due to the orbital motion of the orbiting scroll member. The apparatus is provided with turning means for turning the orbiting scroll member to vary the angular offset of the scroll members, and, hence, alter the compressive effect of the wrap means independently of the operation of the drive means.

In a preferred embodiment of this invention, the turning mechanism comprises a worm gear which is rotatably supported within a gear cover, and a meshing gear tooth portion formed on the outer periphery of an element associated with the rotation preventing mechanism. Therefore, the orbiting scroll member can be turned by the turning mechanism through the rotation preventing mechanism, to thereby change the angular relationship between the spiral elements. If the angular relationship of the scroll members is changed, the line contacts between the spiral curved surfaces of the wrap means are broken, and the sealing of the fluid pockets is cancelled, resulting in no fluid compression. Turning the orbiting scroll member in the opposite direction reestablishes the line contacts to resume fluid compression.

Further objects, features and other aspects of this invention will be understood from the following detailed description of the preferred embodiments of this invention while referring to the annexed drawings.

DETAILED DESCRIPTION OF THE PREFERRED EMBODIMENTS

The detailed description relates to fluid displacement apparatus of the compressor type. The principles of the invention are equally applicable to other types of fluid displacement apparatus.

Before describing a specific embodiment of this invention, the principles of operation of a scroll type compressor will first be described with reference to FIGS. 1*a*–1*d*. These figures may be considered to be end views of a compressor wherein the end plates are removed and only the spiral elements are shown.

Figure 1A:
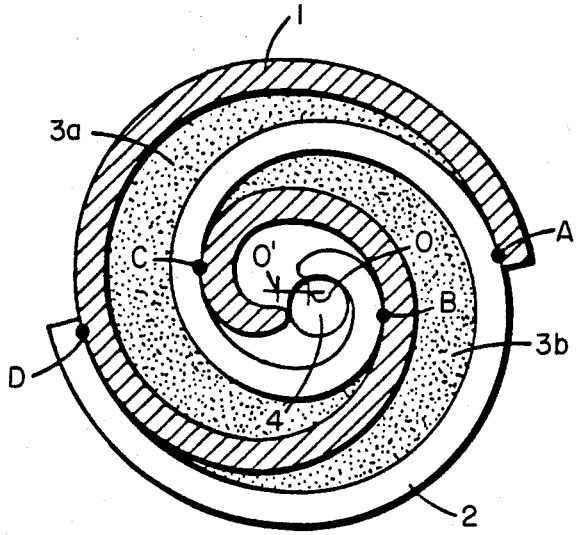
FIGS. 1*a*–1*d* are schematic views illustrating the movement of interfitting spiral elements to compress a fluid.

Two elements 1 and 2 are angularly and radially offset and interfit with one another. As shown in FIG. 1*a*, the orbiting spiral element 1 and fixed spiral element 2 make four line contacts as shown at four points A-D. A pair of fluid pockets 3*a* and 3*b* are defined between line contacts D-C and line contacts A-B, as shown by the dotted regions. The pair of fluid pockets 3*a* and 3*b* are defined not only by the walls of spiral elements 1 and 2, but also by the end plates from which these spiral elements extend. When orbiting spiral element 1 is moved in relation to fixed spiral element 2, so that the center 0' of orbiting spiral element 1 revolves around the center 0 of fixed spiral element 2 with a radius of 0—0' while the rotation of orbiting spiral element 1 is prevented, the pair of fluid pockets 3*a* and 3*b* shift angularly and radially towards the center of the interfitted spiral elements with the volume of each fluid pocket 3*a* and 3*b* being gradually reduced, as shown in FIGS. 1*a*–1*d*. Therefore, the fluid in each pocket is compressed.

Figure 1B:
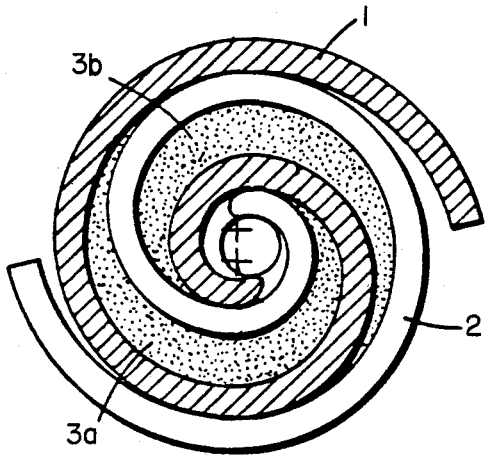
Figure 1C:
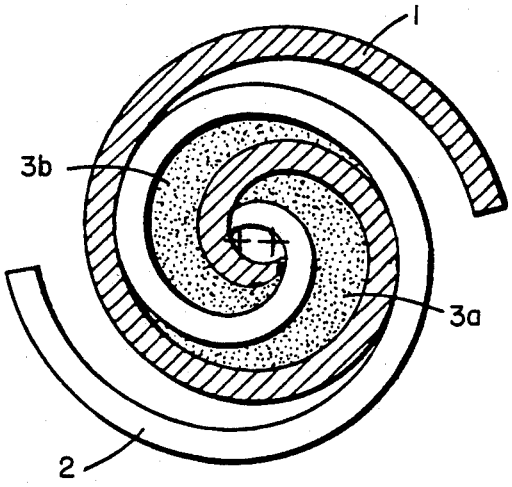
Figure 1D:
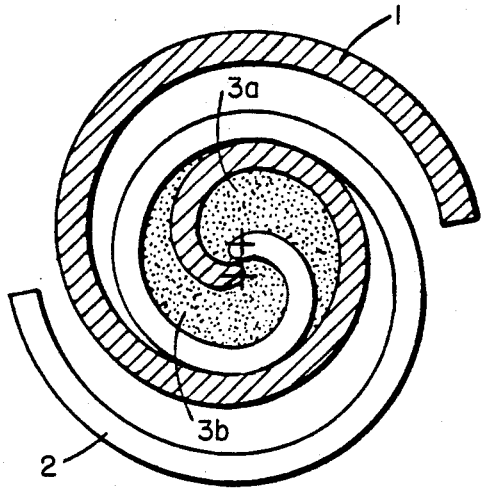

Now, the pair of fluid pockets 3*a* and 3*b* are connected to one another while passing the state from FIG. 1*c* to FIG. 1*d* and, as shown in FIG. 1*a*, both pockets merge at the center portion and are completely connected to one another to form a single pocket. The volume of the connected single pocket is further reduced by further orbital movement of 90° as shown in FIGS. 1*b*, 1*c* and 1*d*. During the course of rotation, outer spaces which are open in the state shown in FIG. 1*b* change as shown in FIGS. 1*c*, 1*d* and 1*a*, to form new sealed off pockets in which fluid is newly enclosed.

Accordingly, if circular end plates are disposed on, and sealed to, the axial ends of spiral elements 1 and 2, and if one of the end plates is provided with a discharge port 4 at the center thereof as shown in the figures, fluid is taken into the fluid pockets at the radial outer portion and is discharged from the discharge port 4 after compression.

Figure 2:
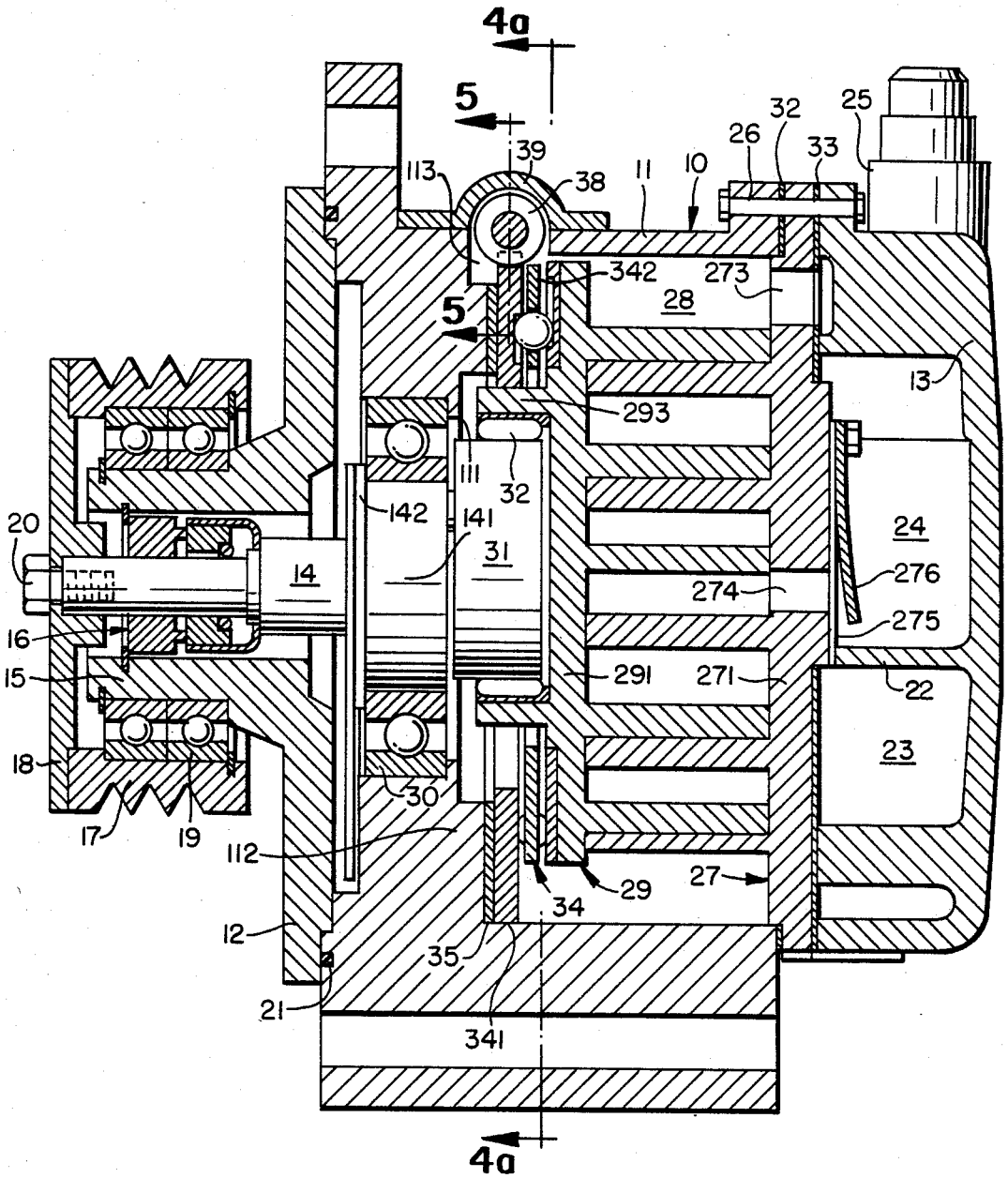
FIG. 2 is a vertical sectional view of a compressor unit of the scroll type according to the invention.

Referring to FIG. 2, a fluid displacement apparatus, in particular, a refrigerant compressor unit according to the present invention is shown. The compressor unit includes a compressor housing 10 comprising a cylindrical housing 11, a front end plate 12 disposed on a front end portion of cylindrical housing 11 and a rear end plate 13 disposed on a rear end portion of the cylindrical housing 11. An opening is formed in from end plate 12 and a drive shaft 14 extends therethrough. Front end plate 12 has a sleeve portion 15 projecting from the front surface thereof, and surrounding drive shaft 14 to define a shaft seal cavity. A shaft seal assembly 16 is assembled on drive shaft 14 within the shaft seal cavity. A pulley 17 is rotatably supported by a bearing means 19 which is disposed on the outer surface of sleeve portion 15. A circular plate member 18 is fixed on the outer end of drive shaft 14 by a key 19 and bolt 20. The end surface of pulley 17 is fixed to the outer portion of the end surface of circular plate member 18. Thus, drive shaft 14 is driven by an external drive power source, for example, an engine of a vehicle through a belt which is connected between the engine and pulley 17, as long as the engine turns.

Front end plate 12 is fixed to the front end portion of cylindrical housing 11, to thereby cover an opening of cylindrical housing 11, and is sealed by an O-ring 21. Rear end plate 13 is provided with an annular projection 22 on its inner surface to partition a suction chamber 23 from discharge chamber 24. Rear end plate 13 has a fluid inlet port 25 and a fluid outlet port (not shown), which respectively are connected to the suction and discharge chambers 23, 24. Rear end plate 13 and circular end plate 271 of a fixed scroll member 27 are fixed to the rear end portion of cylindrical housing 11 by bolts and nuts 26. Circular end plate 271 of fixed scroll member 27 is disposed in a hollow space between cylindrical housing 11 and rear end plate 13 and is secured to cylindrical housing 11 coveing the open rear end of housing 11. Reference numerals 32 and 33 represent a gasket for preventing fluid leakage past the outer perimeter of the end plate 271 and between discharge chamber 24 and suction chamber 23. Fixed scroll member 27 includes circular end plate 271 and a wrap means or spiral element 272 affixed to or extending from one side surface of circular plate 271. Spiral element 272 is disposed in an inner chamber 28 of cylindrical housing 11.

An orbiting scroll member 29 is also disposed in the inner chamber 28. Orbiting scroll member 29 also comprises a circular end plate 291 and a wrap means or spiral element 292 affixed to and extending from one side surface of circular plate 291. The spiral element 292 and spiral element 272 of fixed scroll member 27 interfit at an angular offset of 180° and at a predetermined radial offset. Orbiting scroll member 29 is connected to a driving mechanism and to a rotation preventing mechanism. These last two mechanisms effect orbital motion at a circular radius Ro by the rotation of drive shaft 14, to thereby compress fluid passing through the compressor unit.

Now, the center of orbiting scroll member 29 is placed radially offset from center of fixed scroll member 27 by the distance Ro (FIG. 4*a*); thereby orbiting scroll member 29 undergoes orbital motion of a radius Ro by the rotation of drive shaft 14. As orbiting scroll member 29 orbits, the line contacts between the spiral elements 272, 292 shift to the center of the spiral elements. Fluid pockets defined between the spiral elements 272, 292 move to the center with a consequent reduction of volume to thereby compress the fluid in the fluid pockets. Circular plate 271 of fixed scroll member 27 is provided with a hole or suction port 273 which communicates between suction chamber 23 and inner chamber 28 of cylindrical housing 11. A hole or discharge port 274 is formed through circular plate 271 at a position near to the center of spiral element 272 and is connected to discharge chamber 24. A reed valve 275 and associated keeper 276 control fluid discharge. Therefore, fluid, such as refrigerant gas, introduced into chamber 29 from an external fluid circuit through inlet port 25, suction chamber 23 and hole 273, is taken into the fluid pockets formed between both spiral elements 272, 292. As orbiting scroll member 29 orbits, fluid in the fluid pockets is compressed and the compressed fluid is discharged into discharge chamber 24 from the fluid pocket of the spiral center through hole 274, and therefrom, discharged through the outlet port to an external circuit.

Figure 3:
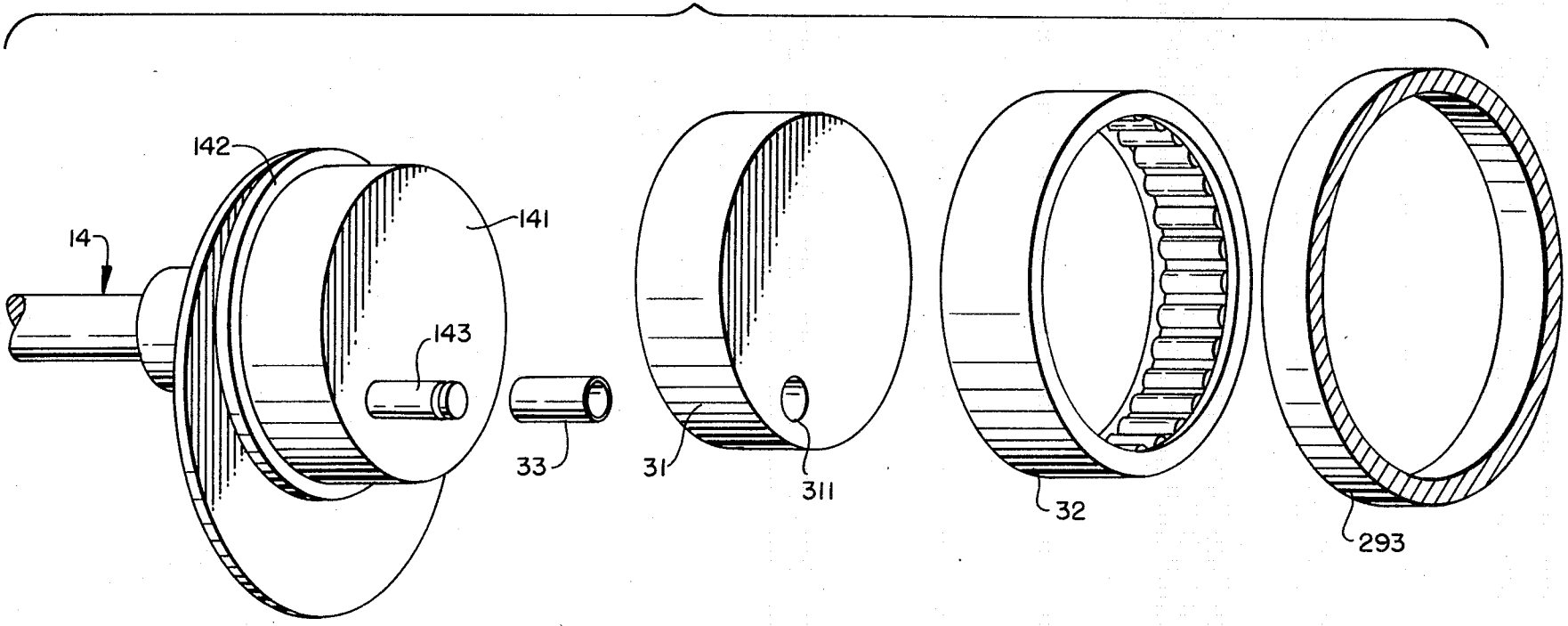
FIG. 3 is an exploded perspective view of the driving mechanism in the compressor of FIG. 2.
Figure 4A:
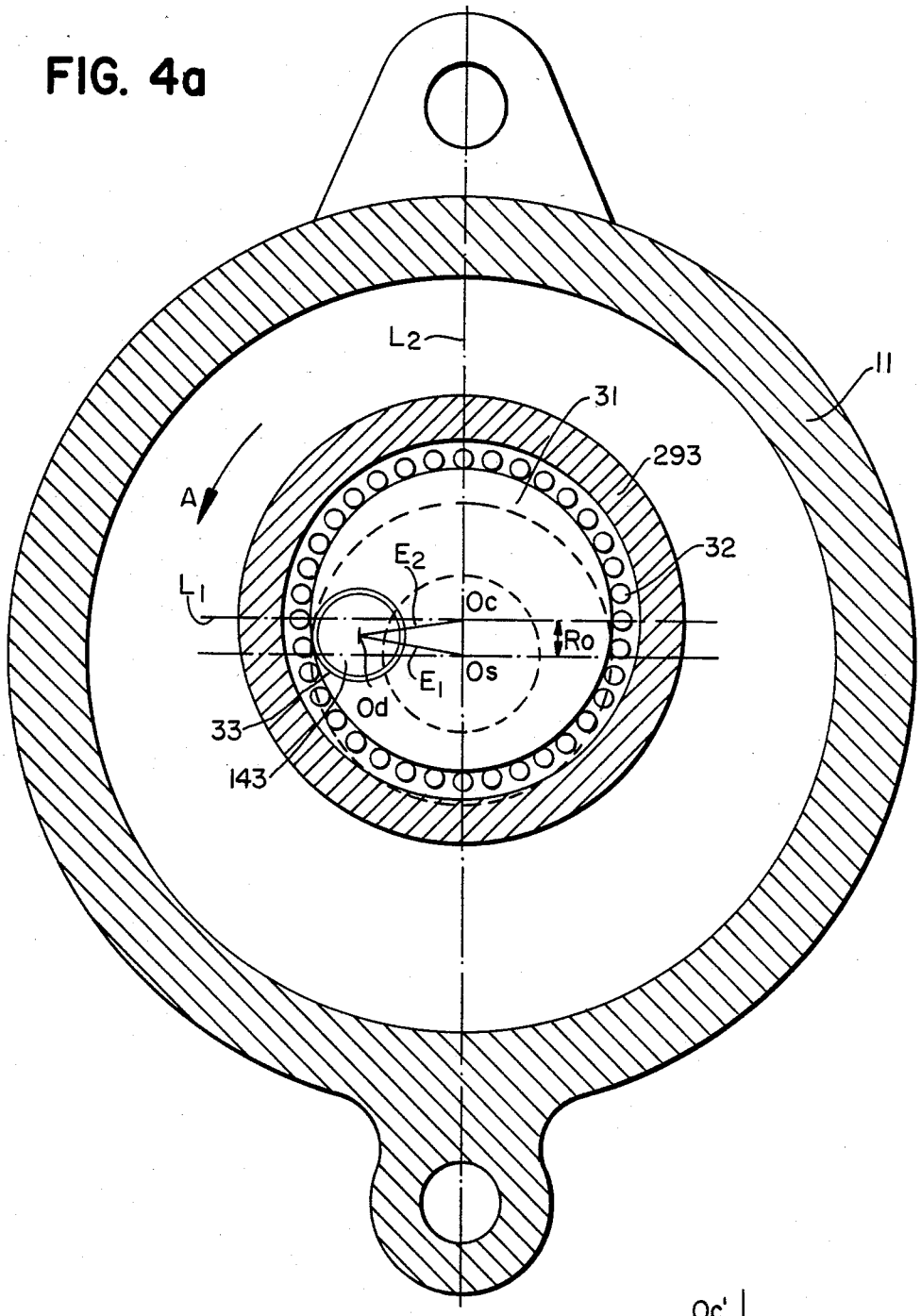
FIG. 4*a* is a sectional view, with parts removed, taken along a line 4*a*—4*a* in FIG. 2.

Referring to FIGS. 2, 3 and 4*a*, a driving mechanism of orbiting scroll member 29 will be described. Drive shaft 14, which extends through front end plate 12, is formed with a disk portion 141 at its inner end. Disk portion 141 is rotatably supported by a bearing means, such as a ball bearing 30, which is disposed in a front end opening of cylindrical housing 11. An inner ring of ball bearing 30 is fitted against a collar 142 formed with disk portion 141, and the other outer ring is fitted against a collar 111 formed at the front end opening of cylindrical housing 11. Therefore, ball bearing 30 is firmly supported without axial motion.

A crank pin or drive pin 143 axially projects from an end surface of disk portion 141 and, hence, from an end of drive shaft 14, and is radially offset from the center of drive shaft 14.

Circular plate 291 of orbiting scroll member 29 is provided with a tubular boss 293 axially projecting from an end surface opposite the side from which spiral element 292 extends. A discoid or short axial bushing 31 is fitted into boss 293, and is rotatably supported therein by a bearing means, such as a needle bearing 32. An eccentric hole 311 is formed in the bushing 31 radially offset from the center of bushing 31. Drive pin 143 is fitted into the eccentrically disposed hole 311 preferably within a bearing sleeve 33. Bushing 31 is therefore driven by the revolution of drive pin 143 and permitted to rotate by the bearing means 32.

Figure 4B:
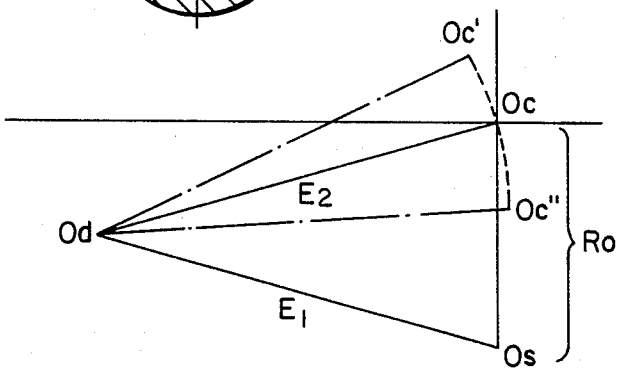
FIG. 4*b* is a schematic illustration of the geometry of the driving mechanism in the compressor of FIG. 2.

Respective placement of center 0s of drive shaft 14, center 0c of bushing 31, and center 0d of hole 311 and thus of drive pin 143 is shown in FIGS. 4*a* and 4*b*. In the position shown in FIG. 4*a*, the distance between 0s and 0c is the radius Ro of orbital motion, and when drive pin 143 is fitted to eccentric hole 311, the eccentric throw $E_1$ between center 0d of drive pin 143 and center 0s of drive shaft 14, and the eccentric throw $E_2$ between center 0d of drive pin 143 and center 0c of bushing 31 are equal.

In this construction of the driving mechanism, center 0c of bushing 31 is permitted to swing about the center 0d of drive pin 143 at a radius E2 as shown in FIG. 4*b*. Such swing motion of center 0c is illustrated as arc 0c'-0c" in FIG. 4*b*. This permitted swinging motion or compliance allows the orbiting scroll member 29 to compensate its motion for changes in Ro due to wear on the spiral elements 272, 292, to dimensional inaccuracies of the elements, or to the presence of small amounts of incompressible material, such as liquid droplets, between the elements.

The center of orbiting scroll member 29 orbits with the radius Ro around center 0s of drive shaft 14. The rotation of orbiting scroll member 29 is prevented by a rotation preventing mechanism, described more fully hereinafter, whereby orbiting scroll member 29 only orbits and does not rotate. The fluid pocket moves because of the orbital motion of orbiting scroll member 29, to thereby compress the fluid.

Figure 5:
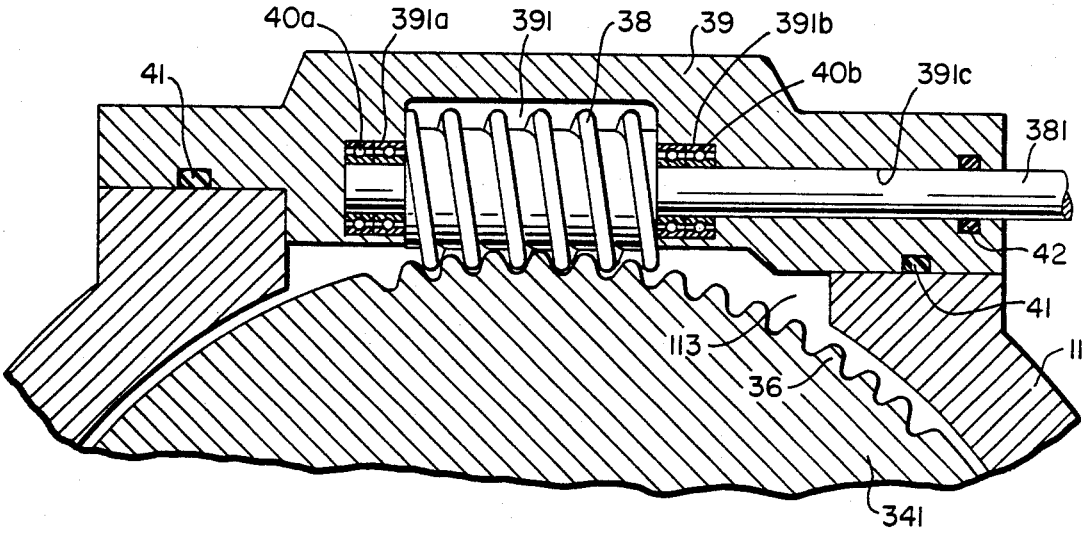
FIG. 5 is a sectional view taken along line 5—5 in FIG. 2.
Figure 6:
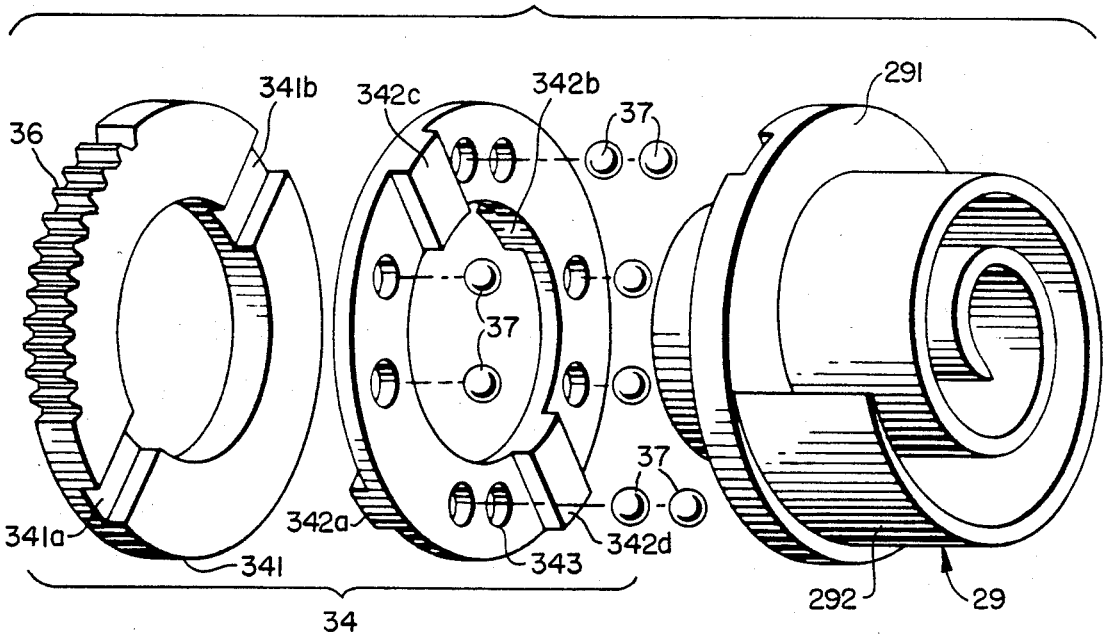
FIG. 6 is an exploded perspective view of the rotation preventing mechanism in the compressor of FIG. 2.
Figure 7:
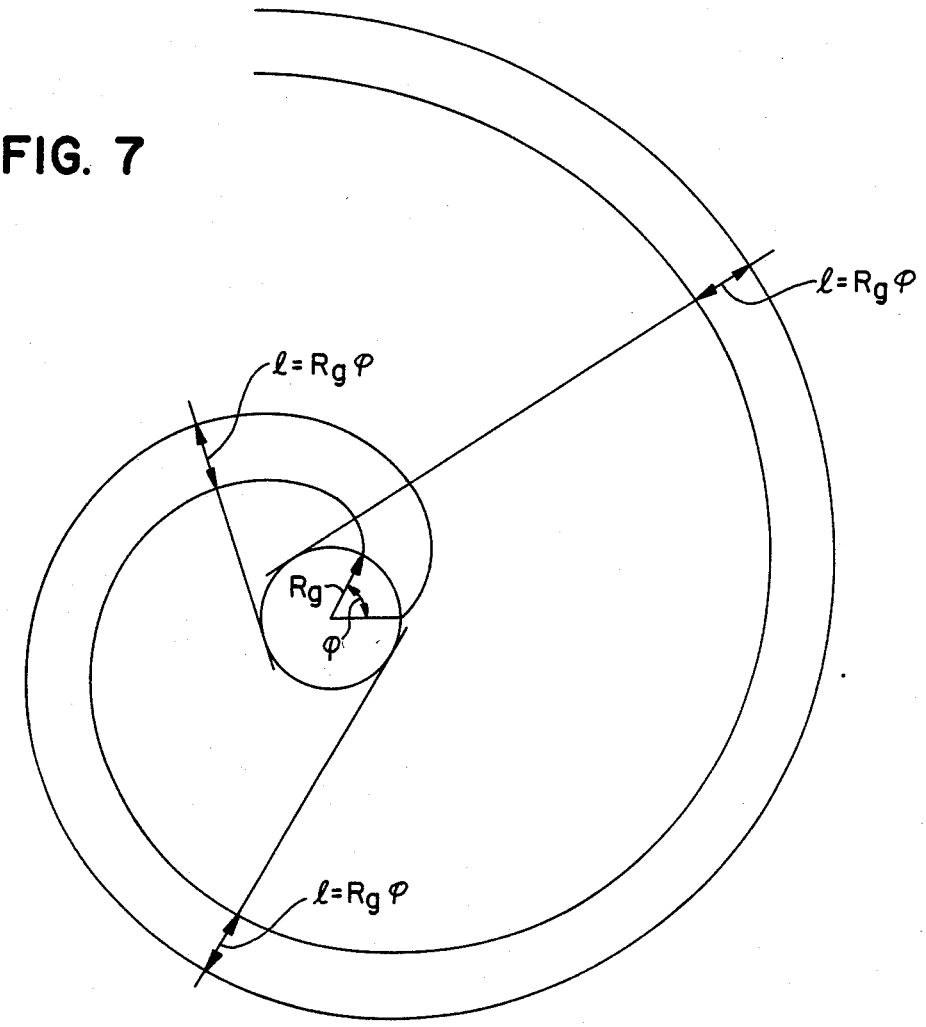
FIG. 7 is a schematic view illustrating the nature of an involute curve.

Referring to FIGS. 2, 5 and 6, a rotation preventing/-thrust bearing mechanism 34 will be described. Rotation preventing/thrust bearing mechanism 34 is disposed to surround boss 293 of orbiting scroll member 29 and is comprised of a fixed coupling element, such as an Oldham plate 341 and a movable coupling element, such as Oldham ring 342. Oldham plate 341 is rotatably supported by a step portion 112 which is formed on the inner surface of cylindrical housing 11 through a thrust bearing 35. Oldham plate 341 is provided with a pair of keyways 341*a*, 341*b* in an axial end surface facing orbiting scroll member 29, and has a toothed portion 36 on the outer peripheral surface thereof. Oldham ring 342 is disposed in a hollow space between Oldham plate 341 and circular plate 291 of orbiting scroll member 29. Oldham ring 342 is provided with a pair of keys 342*a*, 342*b* on the surface facing Oldham plate 341, which are received in keyways 341*a*, 341*b*. Therefore, Oldham ring 342 is slidable in the radial direction by the guide keys 342*a*, 342*b* within keyways 341*a*, 341*b*. Oldham ring 342 is also provided with a pair of keys 342*c*, 342*d* on its opposite surface. Keys 342*c*, 342*d* are arranged along a diameter perpendicular to the diameter along which keys 342*a*, 342*b* are arranged. Circular plate 291 of orbiting scroll member 29 is provided with a pair of keyways on a surface facing Oldham ring 342 in which are received keys 342*c*, 342*d*. Therefore, orbiting scroll member 29 is slidable in a radial direction by guide of keys 342*c*, 342*d* within keyways of circular plate 271.

Accordingly, orbiting scroll member 29 is slidable in one radial direction with Oldham ring 342, and is slidable in another radial direction independently. The second sliding direction is perpendicular to the first radial direction. Therefore, rotation of orbiting scroll member 29 is prevented, while it is permitted to move in two radial directions perpendicular to one another. Now, Oldham ring 342 is provided with a plurality of holes or pockets 343, and bearing means, such as balls 37 each having a diameter which is greater than the thickness of Oldham ring 342, are retained in pockets 343. Balls 37 contact and roll on the surface of Oldham plate 341 and circular plate 291. Therefore, the thrust load from orbiting scroll member 29 is supported on Oldham plate 341 through balls 37.

Cylindrical housing 11 is formed with an opening 113 at its periphery, and opening 113 is in registry with toothed portion 36 of Oldham plate 341. A gear cover 39 including a worm gear 38 is disposed over opening 113. Worm gear 38 meshes with toothed portion 36 of Oldham plate 341. Gear cover 39 is formed with a cavity 391 for receiving worm gear 38, a blind bore 391*a*, a through bore 391*c* and an annular recess 391*b* at the inner end of bore 391*c*. A pair of bearings 40*a*, 40*b* are respectively disposed in bore 391*a* and recess 391*b*. Worm gear 38 has a stub shaft received in bearing 40*a*, and a shaft 381 which passes through bearing 40*b* and out of gear cover 39 through bore 391*c*. Worm gear 38 is therefore rotatably supported in gear cover 39 by bearings 40*a*, 40*b*. The outer end of shaft 381 is connected to an external power source, for example, a servomotor (not shown) for turning worm gear 38. A sealing member, such as O-ring 41, is disposed in a groove in the surface of gear cover 39 facing cylindrical housing 11 for sealing opening 113. A further sealing member (such as an O-ring) 42 is disposed in a groove in gear cover 39 surrounding shaft 381.

Oldham plate 341 is prevented from turning by engagement of worm gear 38 with toothed portion 36, so that Oldham plate 341 can perform its rotation preventing function. When worm gear 38 is turned by the external power source, Oldham plate 341 is turned accordingly. Oldham plate 341 is supported by stepped portion 112 of the inner wall of cylindrical housing 11 through bearing means 35, so that turning movement of the Oldham plate is smooth.

When Oldham plate 341 is turned by worm gear 38, orbiting scroll member 29 is turned in the same direction as Oldham plate 341 through engaged Oldham ring 342, thereby changing the angular relationship between spiral elements 272, 292. When the scroll members are interfitted with one another in the normal state, the pair of sealed off fluid pockets created by the line contacts between the spiral elements are symmetrically formed, but if one scroll member is turned to change the angular relationship between the spiral elements, the line contacts are broken and the sealed off state of the pair of fluid pockets is cancelled. Thus, the high pressure space at the center of the spiral elements is connected to the outer portion of the spiral elements. Therefore, fluid compression is precluded even though the orbiting scroll member continues to be driven by the drive mechanism.

Referring to FIGS. 7, 8, 9 and 10, the above operation will be described in detail. The curve of the spiral elements is usually an involute curve of a circle. Consider in FIG. 7 two involute curves which begin at points on a generating circle having a radius $R_g$ and are angularly offset by an angle $\phi$ about the center of the generating circle. The distance l between these two curves taken along any tangent to the generating circle is always a constant ($l=R_g\phi$). These two curves would define the inner and outer surfaces of a spiral element having a thickness $l=R_g\phi$.

Figure 8A:
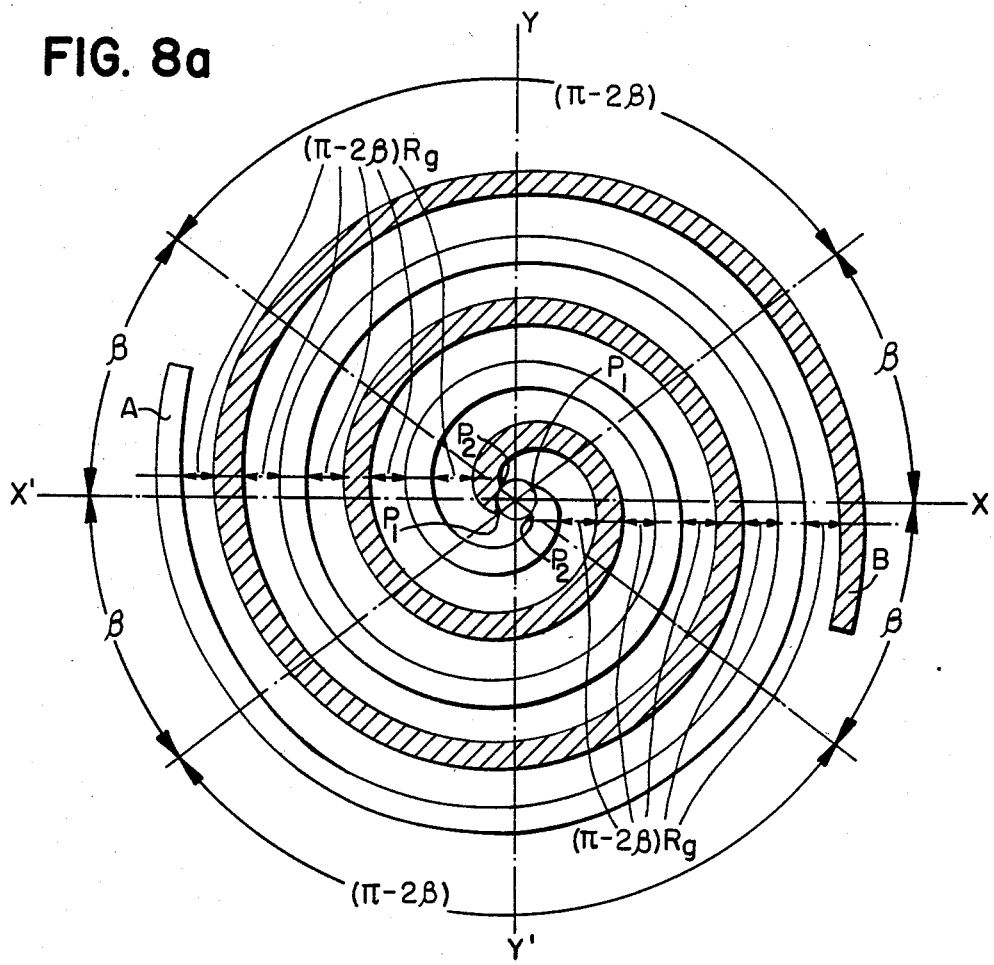
FIG. 8(A) is a schematic view illustrating the two spiral elements interfitted with an angular offset of 180°.

Referring to FIG. 8, points $P_1$ and $P_2$ are established on the generating circle and are placed on both sides of an arc which are angularly offset by an angle $2\beta$ about the center of the generating circle. The two involute curves, which begin at the two points $P_1$ and $P_2$ on the generating circle, are drawn in the same direction. The first spiral element A, which has a thickness defined by these two involute curves as the inner and outer surface, is thus obtained. The second spiral element B, which has the same configuration as the first spiral element, is interfitted with the first spiral element A with an angular offset of 180°. For ease of understanding, both centers of the two generating circles are located at the same position. The second spiral element thus is disposed just in the halfway of the pitch distance of the first spiral element A, as shown in FIG. 8(A). At this time, the distance between the outer surface of first spiral element A and inner surface of second spiral element B, and also the distance between the inner surface of first spiral element A and the outer surface of second spiral element B are all made equal and are defined by $(\pi-2\beta)R_g$.

Figure 8B:
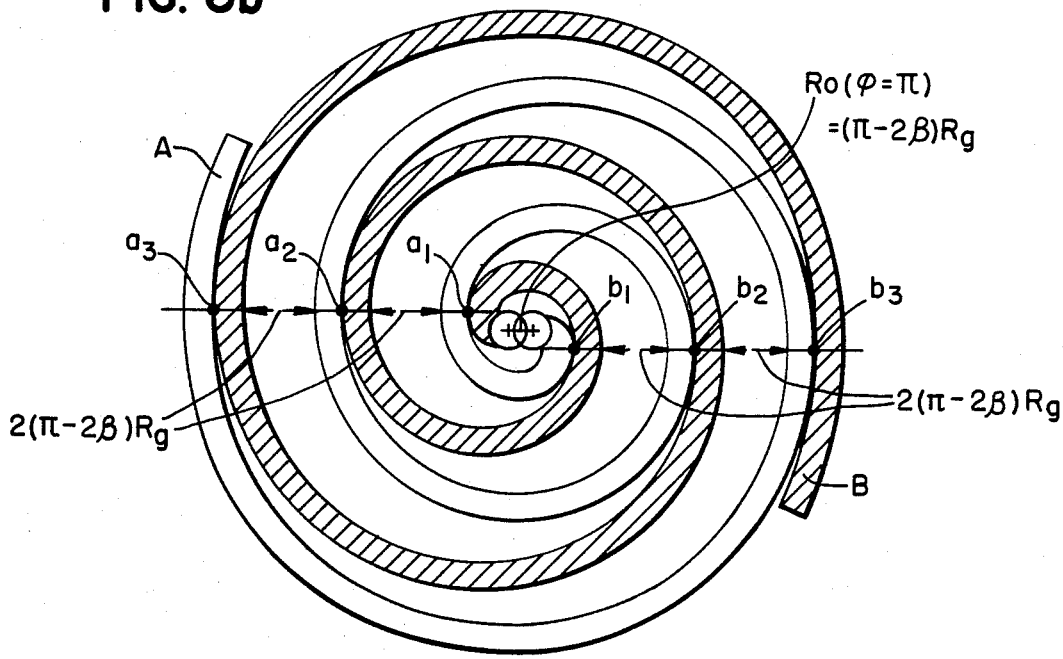
FIG. 8(B) is a schematic view illustrating the normal state of interfitting spiral elements.

If, the second spiral element B is moved in an arbitrary radial direction by $(\pi-2\beta)R_g$ without rotating, the inner surface of first spiral element A will make contact with the outer surface of second spiral element B at points $a_1$, $a_2$, $a_3$ and the outer surface of first spiral element A will make contact with the inner surface of second spiral element B at points $b_1$, $b_2$, $b_3$, to create a number of sealed off fluid pockets therebetween, as shown in FIG. 8(B). The second spiral element B can orbit with the radius Ro, which is equal to the distance of movement of second spiral element B, explained above. All of the contact points shift toward the center of the spiral elements and the fluid in the pockets is compressed as described above in connection with FIG. 1. The orbiting radius Ro of second spiral element B is, therefore, $Ro=(\pi-2\beta)R_g$.

Figure 9A:
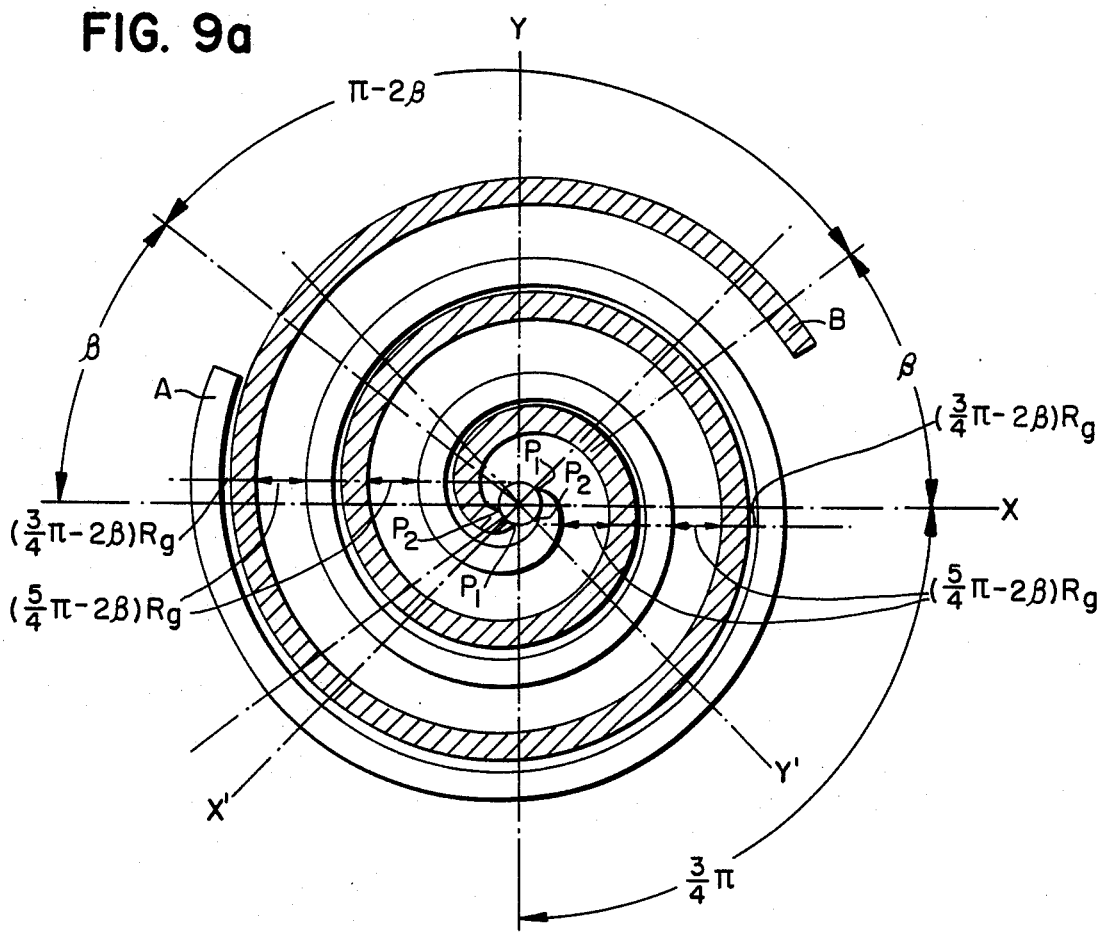
FIG. 9(A) is a schematic view illustrating the two spiral elements interfitted with an angular offset of 135°.
Figure 9B:
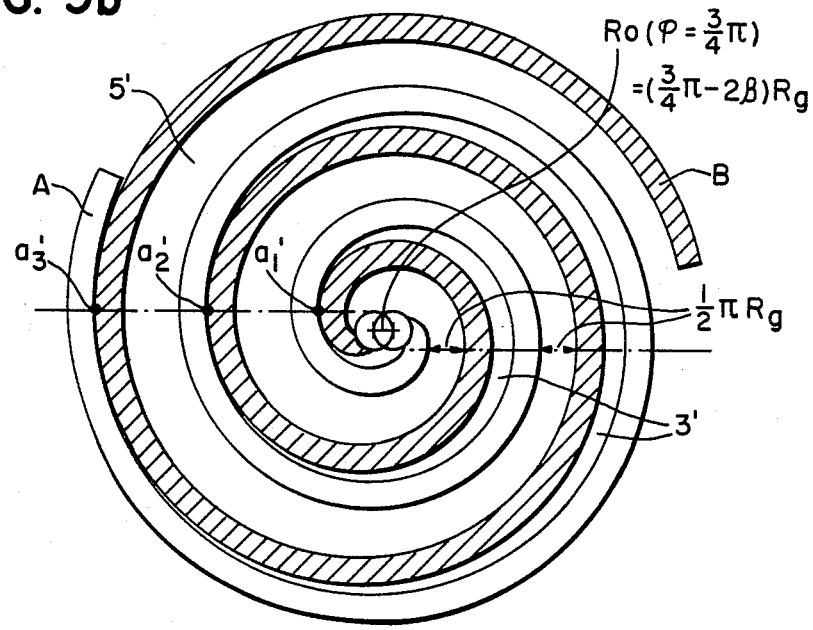
FIG. 9(B) is a schematic view illustrating the altered state of spiral elements, wherein the orbiting scroll member has been partially turned.

FIG. 9 illustrates a condition wherein the second spiral element B is interfitted with the first spiral element A with an angular offset of 135° ($\frac{3}{4}\pi$ radians), hence, second spiral element B has been turned 45° clockwise from the normal state which is shown in FIG. 8(A). The distance between the inner surface of first spiral element A and the outer surface of spiral element B is $(\frac{3}{4}\pi-2\beta)R_g$ and the distance between the outer surface of first spiral element A and the inner surface of second spiral element B is $(5/4\pi-2\beta)R_g$, as shown in FIG. 9(A). Therefore, if the second spiral element B is moved to an arbitrary radial direction by $(\frac{3}{4}\pi-2\beta)R_g$, the outer surface of second spiral element B will make contact with the inner surface of first spiral element A at points $a_1'$, $a_2'$, $a_3'$. However, the inner surface of second spiral element B cannot reach the outer surface of first spiral element A, and contact points $b_1$, $b_2$, $b_3$ are not made, since the distance $(5/4\pi-2\beta)R_g$ between the inner surface of second spiral element B and the outer surface of first spiral element A is greater than the distance $(\frac{3}{4}\pi-2\beta)R_g$, as shown in FIG. 9(B). The orbiting radius of second spiral element B is, therefore, $Ro=(\frac{3}{4}\pi-2\beta)R_g$. Symmetrical sealed off fluid pockets are not formed, because the only contact between the inner surface of first spiral element A and the outer surface of second spiral element B is at points $a_1'$, $a_2'$, $a_3'$.

Asymmetrical fluid pockets 3' are formed between contact points $a_1$, $a_2$, $a_3$. As spiral element B orbits, however, and each pocket 3' is shifted toward the center of the spiral elements, and pockets 3' eventually communicate with the suction chamber through channel like space 5'. Hence, such a change in the angular offset of the spiral elements by rotation of worm gear 38 results in a disappearance of line contacts between the spiral elements at one side and an inability to compress fluid, even though the orbiting spiral element continues to be driven by the driving mechanism.

Figure 10:
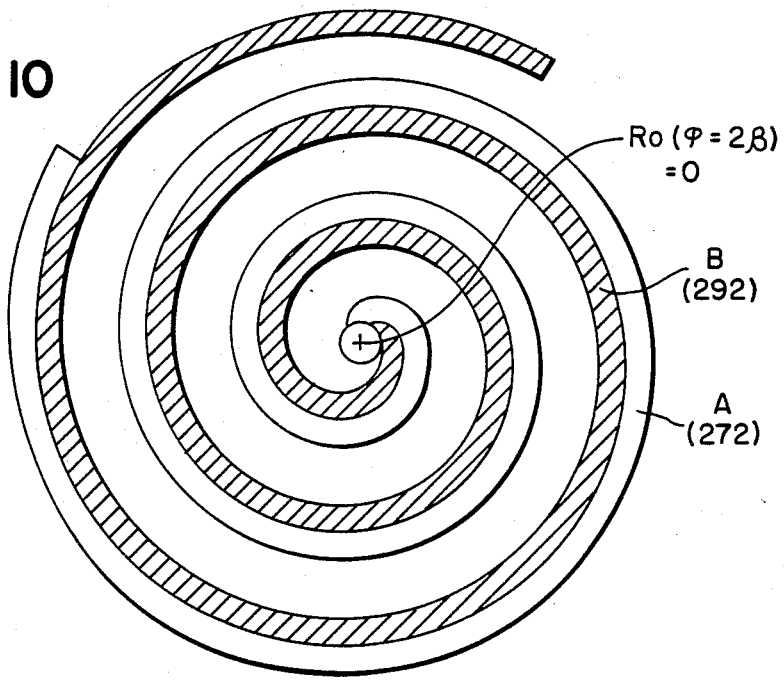
FIG. 10 is a schematic view illustrating the orbiting scroll member held stationary relative to the fixed scroll member.

FIG. 10 illustrates an extreme condition wherein orbiting spiral element B has been turned even further to the point where the angular offset of the spiral element is—and the spiral elements nest within one another. In this condition, the outer wall of spiral element B is contiguous with the inner wall of spiral element A throughout the coextensive lengths of the spirals, so that the orbit radius Ro of spiral element B is reduced to zero. Referring to FIGS. 4*a* and 4*b*, this condition is represented by axial alignment of the center Os of drive shaft 14 and the center Oc of bushing 31. Hence, drive pin 143 and bushing 31 will simply spin together about the axis of drive shaft 14 without imparting orbital motion to spiral element B, thus consuming very little power.

This invention has been described in detail in connection with a preferred embodiment, but this is an example only and the invention is not restricted thereto. It will be easily understood by those skilled in the art that variations and modifications can be easily made within the scope of this invention, which is defined by the appended claims.

I claim:

1. In a scroll type fluid displacement apparatus including a housing having a fluid inlet and a fluid outlet, a fixed scroll member fixedly disposed relative to said housing and having an end surface from which a first wrap means extends into the interior of said bushing, an orbiting scroll member having an end plate means from which a second wrap extends, said first and second wrap means interfitting at an angular and radial offset to make a plurality of line contacts to define at least one pair of sealed off fluid pockets, drive means operatively connected to said orbiting scroll member to effect orbital motion of said orbiting scroll member, and rotation preventing means for preventing rotation of said orbiting scroll member during orbital motion thereof, whereby said fluid pockets change volume by the orbital motion of said orbiting scroll member; the improvement comprising turning means operatively coupled to said orbiting scroll member through said rotation preventing means for varying the angular offset of said first and second wrap means independently of the operation of said drive means, said turning means being operable from the outside of said housing.

2. The improvement as claimed in claim 1 wherein said turning means is operatively connected to said rotation preventing means to turn said orbiting scroll member.

3. The improvement as claimed in claim 2 wherein said turning means comprises a worm gear and a meshing gear tooth portion formed on an element associated with said rotation preventing means.

4. The improvement as claimed in claim 3 wherein said worm gear is rotatably supported within a gear cover, said housing has an opening in registry with said gear tooth portion of said element, and said gear cover overlies said opening so that said worm gear engages said gear tooth portion.

5. The improvement as claimed in claim 3 wherein said element having said gear tooth portion is rotatably supported in said housing by bearing means.

6. The improvement of claim 1 or 3 wherein said turning means is capable of bringing said first and second wrap means into nesting relationship so that they are contiguous throughout their coextensive lengths, to thereby arrest the orbital motion of said orbiting scroll member independently of the operation of said drive means.

* * * * *

UNITED STATES PATENT AND TRADEMARK OFFICE

CERTIFICATE OF CORRECTION

PATENT NO. : 4,551,078

DATED : November 5, 1985

INVENTOR(S) : Masaharu Hiraga

It is certified that error appears in the above-identified patent and that said Letters Patent is hereby corrected as shown below:

Column 7, line 42, "1" should be $-\ell-$;

line 44, "$(1 = R_g\phi)$" should be $-(\ell = R_g\phi)-$; and line 46, "$1 = R_g\phi$" should be $-\ell = R_g\phi-$.

Signed and Sealed this

*Eleventh* Day of *February 1986*

[SEAL]

*Attest:*

DONALD J. QUIGG

*Attesting Officer*

*Commissioner of Patents and Trademarks*